US005892330A

United States Patent [19]

Widmayer

[11] Patent Number: 5,892,330

[45] Date of Patent: Apr. 6, 1999

[54] MANUALLY CONTROLABLE LIGHT FEEDBACK ADJUSTMENT DEVICE FOR GAS DISCHARGE LIGHTING SYSTEMS

[76] Inventor: Don F. Widmayer, 4709 Locust Hill Ct., Bethesda, Md. 20814

[21] Appl. No.: 840,661

[22] Filed: Apr. 25, 1997

[51] Int. Cl.[6] ..... H05B 37/00

[52] U.S. Cl. ..... 315/151; 315/156; 315/158; 250/239

[58] Field of Search ..... 250/237 R, 239; 315/149, 150, 151, 155, 156, 157, 158, 159

[56] References Cited

U.S. PATENT DOCUMENTS 4,568,826 2/1986 Pitel et al. ..... 250/237 R
5,404,080 4/1995 Quazi ..... 315/151

*Primary Examiner*—Don Wong
*Assistant Examiner*—David H. Vu
*Attorney, Agent, or Firm*—Larson & Taylor

[57] ABSTRACT

A light sensor and light feedback adjustment device is provided for use with a control unit for selectively controlling the light output of at least one lamp of a ceiling-mounted luminaire to which the unit is connected, based at least in part on the level of ambient light feedback to the unit. The device includes a lens holder, a lens element screw-mounted on the lens holder and including a light gathering lens, and an arrangement for, in use, securing the lens holder in place in a ceiling tile of the ceiling on which the luminaire is mounted. The lens holder includes a tubular mounting portion including a central bore therein in which is disposed a fiberoptic bundle that receives light gathered by the lens. A light feedback adjustment arrangement includes an adjustable set screw mounted for movement in a transverse passage located in the lens holder between the lens element and the fiber optic bundle so as to vary the light coupled to the bundle.

18 Claims, 1 Drawing Sheet

MANUALLY CONTROLABLE LIGHT FEEDBACK ADJUSTMENT DEVICE FOR GAS DISCHARGE LIGHTING SYSTEMS

FIELD OF THE INVENTION

The present invention relates to light control systems which use light feedback to control the light output of associated lamps and, more particularly, to an improved device or mechanism for adjusting or limiting such light feedback.

BACKGROUND OF THE INVENTION

Most fluorescent lighting systems have a fixed lumen output, except for phosphor degradation effects, i.e., the lumen generating arc is either off or on at a fixed level. However, a number of fluorescent lamps control techniques have, and are being, developed which permit proportional adjustment of the fluorescent lamp arc as a means to establish a more desirable level of lumen output. Savings in electrical energy accrue in such proportional lighting systems where the arc has been reduced from the otherwise "full on" level. Besides the economic implications, the ability to reduce lighting and still meet the requirements of different tasks improves lighting quality. For example, in order to achieve proper contrast and reduce reflections, the background lighting provided in an area surrounding a video display terminal (VDT) is generally lower than that required for high contrast work tasks like reading. Corridors require even lower lighting levels and, in general, to provide for uniform lighting in a building is wasteful of energy. Moreover, the ANSI lighting guidelines for different tasks and building areas vary over a range of at least ten to one, which makes adjustable lighting a highly desirable building lighting feature.

Proportional fluorescent lighting control systems generally use pulse width modulation of the fluorescent arc or variable frequency control of the arc, and/or some form of AC phase control of the fluorescent lamp arc discharge current and other parameters. Often, such systems require the adjustment of a control potentiometer to provide a varying reference or control signal used to establish the level of lamp lumen output. More advanced systems also employ a light sensing means for generating a light feedback signal which varies as a function of the surrounding ambient light. This light feedback signal, after conversion to a related electrical signal, and sometimes after summing with another reference signal, is used to proportionally reduce the average lamp arc current, and hence the light output from the lamps, when a daylight contribution is available. (In an open loop system, the summing operation referred to above may not be required.) Such systems are also designed to increase the average lamp arc current so as to maintain the ambient lighting level at the desired level originally set as the lamp phosphors wear and/or as the lamps and/or luminaire reflecting surfaces accumulate dirt. Without such an increase in the average arc current, an undesired lowering of the lumen output would occur. Presently, this problem is too often solved by the wasteful practice of over-lighting when lamps are new in order to ensure that there will be sufficient lighting when lamps and luminaires become degraded.

It has been shown that localized control of each luminaire is preferred because the contribution from daylight decreases with the distance between the luminaire and the window wall and daylight contributions in different areas may vary as a function of the azimuth angle of the sun, i.e., because of different shading effects produced as the sun moves across the horizon. With such localized control of individual luminaires, each fixture adjusts so that the sum of the daylight and the luminaire light meets the desired level. In contrast, in the case of larger area control of a plurality of luminaires, a standardized lumen output for all luminaires must be established in the area with the least daylight contribution. This results in over-lighting a large majority of the controlled area, i.e., that part of the area which receives a greater amount of daylight than the particular luminaire used to establish the lumen set point and adjustment is precluded for different work tasks or for variations in visual acuity between different workers whose work area is covered by that group of luminaires. Given that such local control is preferred, a simple economical means is necessary to set the lumen output in each local area at the recommended lumen level for the tasks to be performed in that area.

Localized control may be accomplished by utilizing a magnetic transformer ballast with an electronic controller, i.e., a controller such as disclosed in my U.S. Pat. No. 4,352,045, or a variable frequency or pulse width modulated electronic ballast or yet other means. In all cases, an optical pickup device is necessary to measure the localized light level. The light level measurement is converted into a corresponding electrical feedback signal. This signal is then used to control the lumen output of the luminaire. In this regard, the lumen output is increased if the ambient lumen level in the surrounding area decreases, e.g., as the daylight wanes. On the other hand, the lumen output is decreased if the ambient lumen level in the surrounding area increases, e.g., the amount of daylight increases.

Because the control unit, whether an electronic ballast or other controller, is generally mounted in a closed ballast compartment within the luminaire, the unit is not easily accessible for adjustment purposes. Hence, any light adjustment is best accomplished outside of the ballast compartment by maintenance personnel. In previous systems developed by me, this adjustment was made by attenuating the sensed light measurement by varying the distance from the light pickup lens to the optical-electrical transducer which converts the sensed light signal into a corresponding electrical signal. In this regard, in 1978 I developed a system employing an acrylic plastic lens as the light sensor, a fiber optic bundle and a photocell transducer wherein the distance between the lens and the fiber optic bundle was varied by manually adjusting the relative position of the fiber optic bundle in order to provide the desired set point. A system of this general type, i.e., one using a light collector and a fiber optic bundle, and one which, in practice, was adjusted as just described, is disclosed in my U.S. Pat. No. 4,234,820 (Widmayer).

A later development of my basic idea is disclosed in U.S. Pat. No. 4,383,288 (Hess, II et al) which is assigned to Conservolite, Inc., a then licensee of the assignee of U.S. Pat. No. 4,234,820 mentioned above. This patent discloses varying the output of a light collector device including a light sampler or gatherer (including a collecting lens) and a light receiver (including a fiber optic bundle) by, as in the prior art system referred to above, varying the distance between the light sampler and light receiver. This is accomplished in the light collector device of the Hess, II patent by mounting the light sampler (lens) with a threaded portion which is received in a threaded bore in the receiver so that by threading the light sampler into and out of the light receiver, the distance between the lens and the fiber optic bundle can be varied. The Hess, II patent provides that by threading the sampler further into the receiver, the amount of light transmitted to the illumination level control system is increased, thereby raising the illumination level in the controlled area, and that threading the sampler further out of the receiver produces the opposite effect. The light collector is illustrated in the patent as being secured to a specially shaped mounting bracket which is mounted on a T-bar of a suspended ceiling.

There are a number of disadvantages associated with the adjustable light collector of Hess, II. For example, the device requires either gripping the collecting lens directly with the fingers to provide the necessary threading in or out of the light sampler, or else requires the use of a special tool to perform this task, and it will be appreciated that both of these approaches have obvious shortcomings. Further, the mounting arrangement is cumbersome and the overall device is relatively complex given the purpose to be carried out.

SUMMARY OF THE INVENTION

In accordance with the invention, a simple, reliable and economical mechanical device is provided for setting or adjusting the lumen output in local or large area lighting control systems. Access to the reference signal input port is not required and the previously adjustable reference input signal is set to a fixed level. As a result, the system, with a sufficiently high light feedback signal, will provide the minimum lumen output with new lamps, clean luminaire reflecting surfaces and diffuser, and no daylight contribution to the ambient lighting. After the installation of the device in the ceiling, and with the luminaire operating at its minimum lumen output level, the installer can adjust the lumen output upward by mechanically restricting the amount of light permitted to be transmitted to the optical-electrical transducer.

In accordance with the invention, the lumen output level is set by adjusting a simple set screw or like adjustment element mounted in a light sensing lens holder of the device. In particular, to increase the light output of the luminaire, the set screw is advanced inwardly to block the light passageway so as to reduce the feedback signal amplitude, thereby calling for more light. When the light passageway is completely blocked, no light feedback will be present and maximum lumen output will be present. On the other hand, when the light passageway is unobstructed, maximum light feedback will be present and the minimum light output will be present. Thus, any lumen output within the minimum-maximum range is mechanically established by the set screw and, once established under the conditions described above, the feedback signal will increase when daylight contributions are added and will decrease when daylight contributions are subtracted. Further, the system can be adjusted to maintain the set level with lamp phosphor or luminaire reflection degradation. Thus, it will be appreciated that the system can be adjusted to maintain the desired level of light and when no daylight is present, the level of light needs to be changed to accommodate a particular task, maintenance personnel can readily readjust the set screw to whatever level is desired and that level is thus sustained.

According to a preferred embodiment of the invention, there is provided, for use with a control unit for selectively controlling the light output of at least one lamp of a ceiling-mounted luminaire to which the unit is connected, based at least in part on the level of ambient light fed back to the unit, a light sensor and light feedback adjustment device comprising: a lens holder, a lens element mounted on the lens holder and including a light gathering lens, and means for, in use, securing the lens holder in place in a ceiling tile of the ceiling in or on which the luminaire is mounted or on or within the luminaire when no daylight is available, the lens holder including a tubular mounting portion including a central bore therein and having a free end which, in use, extends through the ceiling tile, or on a bracket or brackets on or in the luminaire, the device further including a fiber optic bundle disposed in said central bore so as to receive light gathered by the lens, and light feedback adjustment means for controlling the light received by said fiber optic bundle from said lens, said light feedback adjusting means comprising an adjustable set screw mounted for movement in a transverse passage located in said lens holder between said lens element and said fiber optic bundle so as to vary the amount of light coupled to said fiber optic bundle and said securing means including a locking member for, in use, engaging said free end of said tubular mounting portion to secure said lens holder in place.

Other features and advantages of the invention will be set forth in, or apparent from, the detailed description of the preferred embodiments of the invention which is found hereinbelow.

DESCRIPTION OF THE PREFERRED EMBODIMENTS

Figure 1:
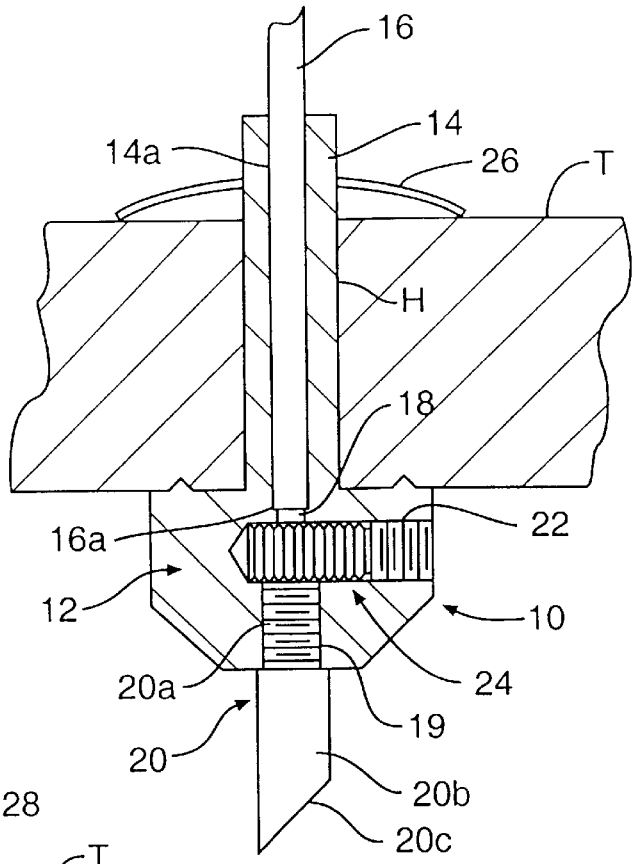
FIG. 1 is a cross sectional view of a light feedback adjustment device constructed in accordance with a first embodiment of the invention.

Referring to FIG. 1, there is shown a first preferred embodiment of the adjustable light feedback control device of the invention. The device, which is generally denoted 10, is mounted in a through hole or opening H in a ceiling tile T, and includes a body portion 12 which acts as a lens holder. An integral elongate mounting stem 14 in the form of a hollow cylinder or tube, extends through hole H.

An optical fiber (fiber optic) bundle 16 is received in the bore 14*a* in mounting stem 14 and is connected back to the control system for the lamps for the luminaire with which the light control device 10 is associated. The free end 16*a* of fiber optic bundle 16 abuts the end of bore 16*a* adjacent a smaller diameter chamber 18 in lens holder body 12.

A larger diameter bore 19 in lens holder body 12, which is coaxial with the bore 14*a* and chamber 18, is threaded to receive the correspondingly threaded end portion 20*a* of a plastic lens element or member 20. Lens member 20 includes a lens 20*b* at the opposite end thereof and can take a number of different forms and which, in the illustrated embodiment, is frustocylindrical in shape and includes a slant face 20*c*. Lens element 20 is made from a light transmissive plastic so that light received by lens 20*b* is transmitted therethrough.

An orthogonal or transverse bore 22 in lens holder body 12 extends into body 12 beyond chamber 18 and threaded bore 19 so as to communicate with both. A suitably threaded set screw 24 is received in transverse, threaded bore 22 and is adjustable in position along the length of bore 22, using a simple screwdriver, so as to control the range of light transmitted from lens element 20 to fiber optic bundle 16. In this regard, the amount of light received by fiber optic bundle 16 can be adjusted by varying the position of set screw between a maximum light passage position whereby set screw 24 is withdrawn out of the path between fiber optic bundle 16 and lens element 20, and minimum light passage position which set screw 24 completely blocks this path and thus no light is received by fiber optic bundle 16.

As illustrated, lens holder body 12 includes teeth indicated at 12*a* in the surface thereof which bite into, and mate with, the underside of tile T to more firmly anchor lens holder body 12 in place. A spring-type lock washer 26 engages the free end of mounting stem portion 14 and locks the overall device or unit 10 in place.

In use, the device 10 is installed, in a very simple manner, by merely punching a hole, corresponding to hole H, in tile T, and inserting mounting stem portion 14 therethrough. The flat mating upper surface of lens holder body 12 containing teeth 12*a* is pressed against tile T and lock washer 26 is used to lock the device 12 in this position.

Figure 2:
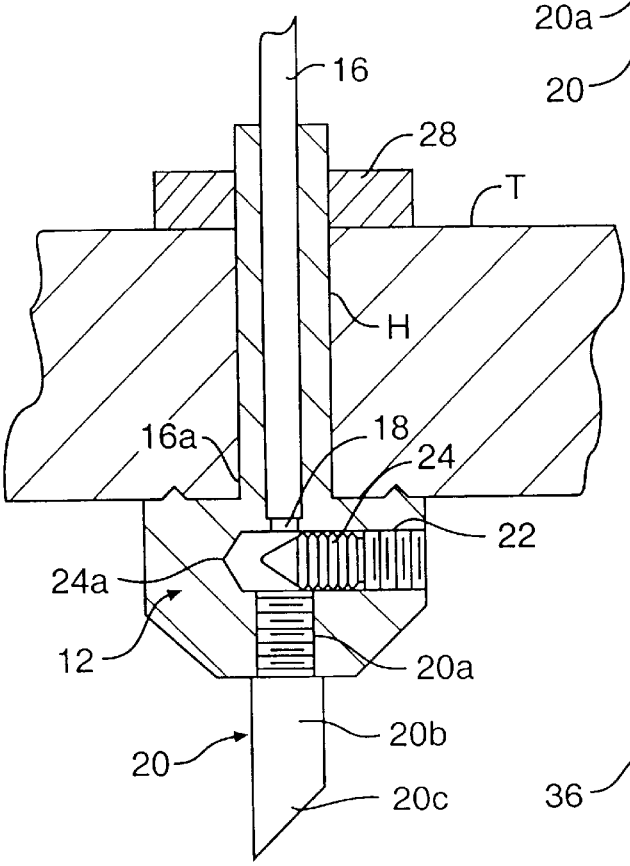
FIG. 2 is a cross sectional view similar to that of FIG. 1 illustrating a second embodiment of the invention.
Figure 3:
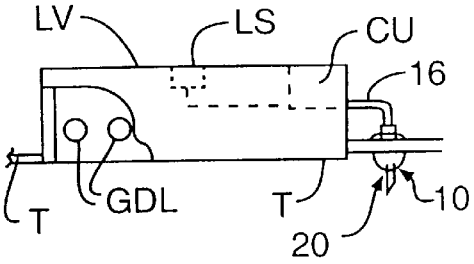
FIG. 3 is a schematic representation of a ceiling-mounted lighting system incorporating the feedback adjustment device of the invention.

Referring to FIG. 3, an alternative embodiment of the invention is shown. The embodiment of FIG. 2 is similar to that of FIG. 1 and corresponding elements have been given the same reference numerals. The only differences between these two embodiments is that, in the embodiment of FIG. 2, a lock nut 28 replaces lock washer 26 of FIG. 1 and a set screw 24 is provided with a shaped end 24*a*. Regarding the former, it has been found in practice that a locking nut has advantages where the device is to be removed (the lock washer can be difficult to disengage). However, it will be appreciated that other suitable fasteners or locking elements can also be used.

Regarding the light blocking end 24*a* of set screw 24, suitable contouring or shaping of this end can be used to characterize or control the amount of light received by optical fiber 16 as set screw 24 is advanced and withdrawn so that a desired light transmission characteristic, as a function of set screw position, can be achieved. Different shapes of end 24*a*, e.g., pointed, rounded, flat or other shapes, can affect the generated light signal.

Referring to FIG. 3, the device 10 is shown installed in a ceiling tile T as described above and connected through fiber optics 16 to a control unit CU which is preferably of the type described in my U.S. Pat. Nos. 5,483,127, issued on Jan. 9, 1996, and 5,519,311, issued on May 21, 1996, and which is used to control the lumen output of the fluorescent lamps or other gas discharge lamps GDL of a conventional luminaire or lighting unit LU mounting in the ceiling formed by tiles T.

It will be appreciated that the light feedback adjustment provided by set screw 24 described above can be used to control the settings of lamps GDL so that, for example, the desired light level is provided by the lamps when no lighting of the area from additional daylight or other ambient light is available.

In the embodiments described thus far, the light signal collected by lens 20 is transmitted through a non-(electrically) conducting fiber optic bundle 16 to a photocell or other suitable light-to-electrical signal transducer (not shown) within control unit CU which is, in turn, conductively coupled to the control circuitry within that unit. In an alternative embodiment, an additional or replacement light sensor LS (see FIG. 3), generally corresponding to that described above, can be directly located within the luminaire or lighting unit LU. In other words, light sensor LS can be employed in addition to device 10, or substituted for that device, e.g., in applications where the luminaire receives no daylight and the light sensor LS is used to monitor degradation of lamp performance over time. In this embodiment, the photocell or other light transducer (not shown in FIG. 3) would be co-located with, i.e., disposed closely adjacent to, the lens 20, thereby eliminating the need for the fiber optic bundle 16.

Figure 4:
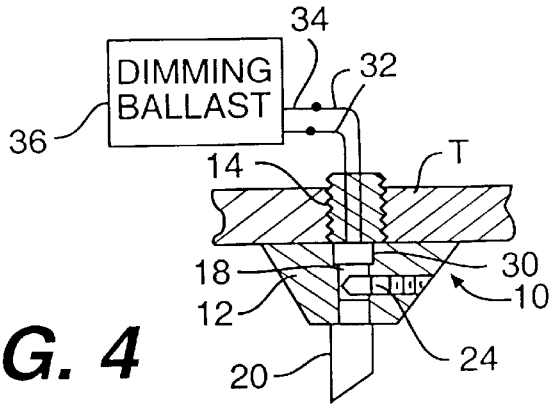
FIG. 4 is a cross section view, similar to that of FIGS. 1 and 2 but to a smaller scale, illustrating a further embodiment of the invention.

An embodiment of the general nature just described is shown in FIG. 4, although in this embodiment, the light feedback control device 10 is supported in a ceiling tile, as in the embodiments of FIGS. 1 and 2, rather than in the housing of the light unit LU. In this embodiment, a photocell 30 is disposed within body portion or lens holder body 12 within chamber 18. Photocell 30 is connected by a pair of electrical signal'wires 32 to the control unit (not shown). It is expected that the electrical signal wires 32 will likely have to be located within an armored cable or conduit (not shown) or first be connected to a photo-isolator at the input to the control circuit.

It is noted that the embodiment of FIG. 4 can be used with a number of commercially available dimming ballasts such as the 277 VAC Mark VII made by Advance Transformer ("Advance") and the Series 700 Model D 232. C277, made by Electronic Lighting, Inc. ("ELI"). These ballasts each have a pair of control wires and provide instructions calling for a variable resistance to be connected across an internal voltage source of the ballast so that a variation of the resistance will provide dimming of lamps connected to the ballast. In the embodiment of FIG. 4, the output wires 32 of photocell 30 are connected to the electronic ballast wires 34 of a dimming ballast 36 so that the light signal sensed by lens 20 (variation of which causes the resistance of photocell 30 to vary) can be used to drive the dimming ballast 36 (which can be an Advance or ELI dimming ballast) over the dimming range thereof.

It will thus be appreciated that by adapting the lens 20, lens holder 12, lighting control set screw 24 and the photocell 30 as described above, the light output of commercial electronic ballasts such as the Advance and ELI ballasts can be set for a given task requirement, user need, or building area so long as the light output of the lamps falls within the dimming range of the ballast. Thereafter, the gas discharge of the lamps automatically increases when depreciation factors cause a light output diminishment and decreases in proportion to daylight contributions, if any, at the lens collection point. Both the Advance and ELI dimming ballasts are generally used with a wall-mounted potentiometer to vary the current signal flow within the ballast and/or with light related electrical signal derived from a single point control system to usually drive a plurality of luminaires wherein the luminaries all have the same output and thus have to be set for the worst case lighting level within that group of luminaires.

Although the present invention has been described to specific exemplary embodiments thereof, it will be understood by those skilled in the art that variations and modifications can be effected in these exemplary embodiments without departing from the scope and spirit of the invention.

What is claimed is:

1. For use with a control unit for selectively controlling the light output of at least one lamp of a ceiling-mounted luminaire to which the unit is connected, based at least in part on the level of ambient light a light sensor and light adjustment device comprising: a lens holder, a lens element mounted on said lens holder and including a light gathering lens, and means for, in use, mounting said lens holder such that said light gathering lens collects light from an ambient area of interest, said lens holder including a mounting portion including a central chamber therein in light communication with said lens element and having a proximal end and a distal end, and said device further including light adjustment means for controlling the light received in said chamber from said lens, said lens holder including a passage extending transversely to said chamber between the proximal and distal ends of said chamber, and said light adjusting means comprising an adjustable set screw mounted for movement in said passage so that movement of said set screw into and out of the chamber varies the amount of light coupled to the proximal end of the chamber, said set screw having a cylindrical body portion and a shaped distal end portion of a different shape than said body portion for providing graduated control of the light coupled to said chamber.

2. A light sensor and light adjustment device as claimed in claim 1 further comprising a photoelectric transducer fixedly mounted in said chamber at the proximal end thereof.

3. A light sensor and light adjustment device as claimed in claim 2 wherein said photoelectric transducer comprises a transducer device having a resistance which varies in response to the amount of light received by the transducer.

4. A light sensor and light adjustment device as claimed in claim 3, wherein said transducer device includes output wires extending outwardly from said lens holder and connected to a dimming ballast such that changes in the resistance of the transducer device produce changes in the dimming provided by said dimming ballast.

5. A light sensor and light adjustment device as claimed in claim 4 wherein said mounting portion has a free end which, in use, extends through a ceiling tile so as to affix the lens holder to the ceiling tile.

6. A light sensor and light adjustment device as claimed in claim 5 further comprises a securing means including a locking member for, in use, engaging said free end of said mounting portion to secure said lens holder in place.

7. A light sensor and light adjustment device as claimed in claim 1, wherein said mounting means comprises means for, in use, securing said lens holder in place in a ceiling tile of the ceiling on which the luminaire is mounted, said device further comprising a fiber optic bundle disposed in said chamber so as to receive light gathered by said lens.

8. A light sensor and light adjustment device as claimed in claim 7 further comprising a further light sensor and light feedback adjusting device located within the luminaire for sensing the light output of said at least one lamp.

9. For use with a control unit for selectively controlling the light output of at least one lamp of a ceiling-mounted luminaire to which the unit is connected, based at least in part on the level of ambient light feedback to the unit, a light sensor and light feedback adjustment device comprising: a lens holder, a lens element mounted on said lens holder and including a light gathering lens, and means for, in use, mounting said lens holder in place in a ceiling tile of the ceiling on which the luminaire is mounted, said lens holder including a tubular mounting portion including a central bore therein and having a free end which, in use, extends through the ceiling tile, said device further including a fiber optic bundle disposed in said central bore so as to receive light gathered by said lens, and light feedback adjustment mean for controlling the light received by said fiber optic bundle from said lens, said light feedback adjusting means comprising an adjustable set screw mounted for movement in a transverse passage located in said lens holder between said lens element and said fiber optic bundle, so as to vary the amount of light coupled to said fiber optic bundle, and said securing means including a locking member for, in use, engaging said free end of said tubular mounting portion to secure said lens holder in place, said set screw having a cylindrical body portion and a shaped distal end portion of a different shape than said body portion for providing graduated control of light coupled to said chamber.

10. A lighting system comprising: a luminaire adapted to be mounted in a ceiling of an area to be illuminated; at least one lamp contained within said luminaire; a control unit for controlling the output of said at least one lamp; a first, interior light sensor, located within the luminaire so as to be shielded from ambient light and connected said control unit, for sensing the light output of said at least one lamp so as to monitor degradation of said least one lamp over time and for providing an output signal based on said light output to said control unit, said first light sensor including adjustment means for controlling the light received thereby so as to adjust the output signal provided to said control unit; and a second, exterior light sensor, adapted to be mounted outside of said luminaire in the ceiling in which the luminaire is mounted adjacent to said luminaire, for monitoring ambient light in an area illuminated by said at least one lamp of the luminaire and for providing an output signal based on said ambient light to said control unit, said second light sensor including adjustment means for controlling the ambient light received thereby so as to adjust the output signal provided by said second light sensor to said control unit.

11. A lighting system as claimed in claim 10 wherein said second light sensor comprises a lens holder, a lens element mounted on said lens holder and including a light gathering lens, and mounting means for, in use, mounting said lens holder such that said light gathering lens collects light from the illuminated area, said light holder including a mounting portion including a central chamber therein in light communication with said lens element and having a proximal end and a distal end, said lens holder including a passage extending transversely to said chamber between the proximal and distal ends of said chamber, and said adjustment means of said second light sensor comprising an adjustable set screw mounted for movement in said passage so that movement of said screw into and out of said passage varies the amount of light coupled to the proximal end of the chamber.

12. A lighting system as claimed in claim 11 further comprising a photoelectric transducer fixedly amounted in said chamber at the proximal end thereof.

13. A lighting system as claimed in claim 12 wherein said photoelectric transducer comprises a transducer device having a resistance which varies in response to the amount of light received by the transducer.

14. A lighting system as claimed in claim 12 wherein said control unit comprises a dimming ballast and wherein said transducer device includes output wires extending outwardly from said lens holder and connected to said dimming ballast such that changes in the resistance of the transducer device produce changes in the dimming provided by said dimming ballast.

15. A lighting system as claimed in claim 14 wherein said mounting portion has a free end which, in use, extends through a ceiling tile of the ceiling in which the luminaire is mounted so as to affix the lens holder to the ceiling tile.

16. A lighting system as claimed in claim 15 further comprising a securing means, including a locking member, for, in use, engaging said free end of said mounting portion to secure said lens holder in place.

17. A lighting system as claimed in claim 11 wherein said mounting means comprises means for, in use, securing said lens holder in place in a ceiling tile of the ceiling in which the luminaire is mounted, said second sensor further comprising a fiber optic bundle disposed in said chamber so as to receive light gathered by said lens.

18. A lighting system as claimed in claim 17 wherein said set screw has a cylindrical body portion and a shaped distal end portion of a different shape than said body portion for providing graduated control of light coupled to said chamber.

* * * * *